United States Patent [19]

Tachihara et al.

[11] Patent Number: 5,074,453

[45] Date of Patent: Dec. 24, 1991

[54] PNEUMATIC FASTENER DRIVING TOOL

[75] Inventors: Sueji Tachihara; Akira Uno, both of Hitachiohta; Katsuaki Tobita, Ibaraki, all of Japan

[73] Assignee: Hitachi Koki Company, Limited, Japan

[21] Appl. No.: 508,628 .

[22] Filed: Apr. 13, 1990

[30] Foreign Application Priority Data

Sep. 8, 1989 [JP] Japan ..... 1-106032[U]
Sep. 8, 1989 [JP] Japan ..... 1-106033[U]

[51] Int. Cl.[5] ..... B25C 1/04
[52] U.S. Cl. ..... 227/130; 227/113; 227/119
[58] Field of Search ..... 227/130, 109, 113, 119, 227/156, 142; 173/17, 115

[56] References Cited

U.S. PATENT DOCUMENTS 1,846,804 2/1932 Hansen ..... 173/17
3,273,469 9/1966 Doyle ..... 227/130 X
3,438,449 4/1969 Smith ..... 227/130 X

*Primary Examiner*—Mark Rosenbaum
*Assistant Examiner*—Rinaldi Rada
*Attorney, Agent, or Firm*—Lowe, Price, LeBlanc & Becker

[57] ABSTRACT

A pneumatic fastener driving tool including a start valve adapted to be open for start a fastener driving operation by pneumatically driving a driving rod forwardly, and a vent hole for connecting to start valve to atmospheric air to let compressed air escape to atmosphere when compressed air is accidentally supplied through the start valve after one cycle of fastener driving operation is completed due to bouncing of the piston, for example.

13 Claims, 8 Drawing Sheets

PNEUMATIC FASTENER DRIVING TOOL

BACKGROUND OF THE INVENTION

1. Field of the Invention

The present invention relates to a pneumatic fastener driving tool for driving fasteners such as nails, staples or the like to workpieces.

2. Description of the Prior Art

Pneumatic fastener driving tools are known, which include, as shown in FIG. 14 of the accompanying drawings, a driving rod 6 connected to a piston 3 and slidably received in a cylindrical barrel 2 for thrusting a fastener 1 which is retained in the barrel 2 in front of the driving rod 6. In the fastener driving operation, a tip end 13 of the fastener 1 is forced against a workpiece 12, thereby causing the driving rod 6 to move rearward (upward in this figure). This rearward movement of the driving rod 6 causes an O-ring 16 on the piston 3 to move upwardly past radial holes 18 formed in the peripheral wall of a cylinder 17, whereupon compressed air rushes through the radial holes 18 into a lower piston chamber 19 to lift the piston 3, thereby starting forward striking movement of the driving rod 6. Thus, the radial holes 18 constitute a start valve which is operative to commence or start the fastener driving operation. After the fastener driving operation, the piston 3 is normally at rest on a damper 4. However, when the driving force of the fastener driving tool is in balance with the resistance of the workpiece 12, or when the piston 3 bounds back from the damper 4 due to excessively large forces or pressure applied thereto, the piston 3 is separated from the damper 4 to such an extent that the start valve 18 is opened at least partly. This means that the pressure in the lower piston chamber 19 increases gradually and thereafter the driving rod 6 is suddenly thrust down again even after a cycle of fastener driving operation is completed. If such accidental fastener driving operation occurs during the manual loading of the next fastener 1, the operator might be seriously injured.

Another drawback of the conventional fastener driving tool is that the fastener driving depth can not be adjusted. When a fastener is to be driven into a workpiece until the head of the fastener lies flush with a surface of the workpiece, or when the fastener is to be driven into the workpiece to such an extent that the head of the fastener projects from the surface of the workpiece by a fixed distance for the purpose of hooking a wire or a fixture, the fastener driving operation using the conventional fastener driving tool must be followed by an additional manual hammering operation. The conventional fastener driving operation is laborious as a whole.

The conventional fastener driving tool has another problem arising when used in combination with hook-shaped fasteners such as shown in FIG. 14. In this instance, the hook-shaped fastener 1 is loaded in the barrel 2 with its leg la held on a side wall 2*a* of the barrel 2 and with a bent end 14*a* of the head 14 projecting outwardly from an axial groove 2*b* in the barrel 2. Since the leg la of the fastener 1 is out of alignment with the driving rod 6, the fastener 1 is likely to be deformed or bent as shown in FIG. 15 or tends to tilt as shown in FIG. 16. Such inadequately driven fasteners must be removed and replaced with a new fastener with the result that the fastener driving efficiency is considerably reduced.

SUMMARY OF THE INVENTION

With the foregoing drawbacks of the prior art in view, it is an object of the present invention to provide a pneumatic fastener driving tool which is capable of driving fasteners efficiently and safely.

According to the present invention, there is provided a pneumatic fastener driving tool which comprises: a reciprocating piston driven by compressed air and having a driving rod for driving a fastener into a workpiece; a cylinder slidably receiving therein the piston and having at least one radial hole, the radial hole constituting a start valve operative to start a fastener driving operation by the driving rod depending on the position of the piston relative to the start valve, the start valve being adapted to be open in response to rearward movement of the driving rod; a fastener driving end portion for holding therein a fastener in front of the driving rod; means defining a vent hole for connecting the start valve to atmospheric air to let compressed air escape to atmosphere; and a control member disposed in the fastener driving end portion and reciprocally movable in a direction parallel to the direction of movement of the driving rod between a first position to open the vent hole and a second position to close the vent hole, the control member being normally disposed in the first position.

According to a preferred embodiment, the pneumatic fastener driving tool further includes a fastener driving depth adjustment device for adjusting the distance between a forward end of the driving rod and a workpiece to which the fastener is to be driven.

The pneumatic fastener driving tool, for use in combination with a hook-shaped fastener having a straight leg and a curved head terminating in a bent end portion, preferably includes a first guide surface engageable with the leg of the fastener and a second guide surface engageable with the bent end portion of the fastener to ensure that the fastener is neatly driven into the workpiece without deformation or tilting.

The above and other objects, features and advantages of the present invention will become more apparent from the following description when making reference to the detailed description and the accompanying sheets of drawings in which preferred structural embodiments incorporating the principles of the present invention are shown by way of illustrative example.

DETAILED DESCRIPTION OF THE PREFERRED EMBODIMENTS

Figure 1:
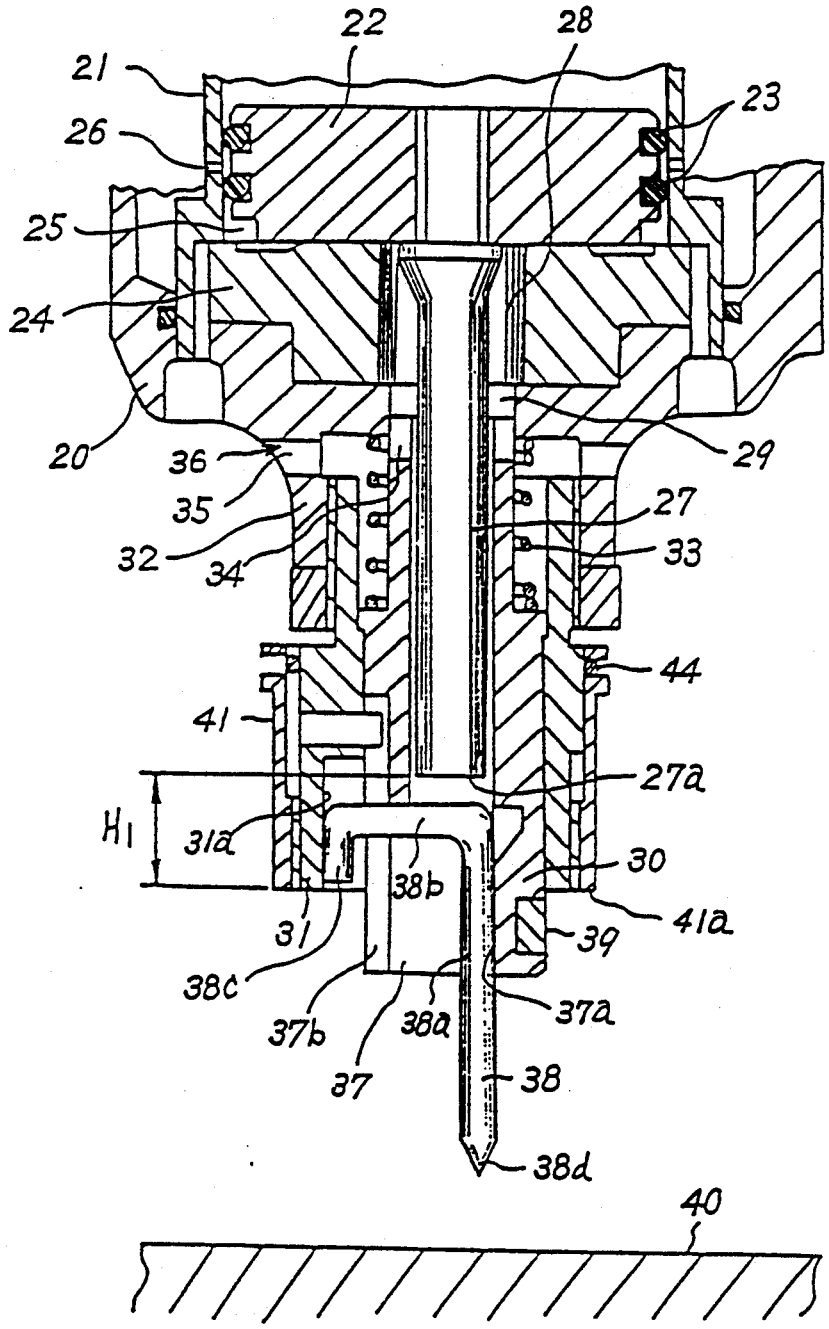
FIG. 1 is a fragmentary longitudinal cross-sectional view of a pneumatic fastener driving tool according to the present invention.

Referring now to the drawings, wherein like reference characters designate like or corresponding parts throughout the several views, and more particularly to FIG. 1, there is shown a main portion of a pneumatic fastener driving tool according to the present invention.

The fastener driving tool includes a tool body 20 having a tubular cylinder 21 in which a piston 22 is slidably received. The piston 22 is sealed from the cylinder 21 by a pair of piston rings in the form of O-rings 23 attached to the periphery of the piston 22. A circular ring-shaped damper 24 is mounted in the tool body 20 at an end of the cylinder 21 so as to define jointly with the piston 22 a lower piston chamber 25. The lower piston chamber 25 is normally separated by the O-ring 23 from radial holes 26 formed in a peripheral wall of the cylinder 21. The radial holes 26 constitute a start valve which is adapted to be open to commence the fastener driving operation depending on its position relative to the position of the piston 22, as described later.

The piston 22 has a concentric driving rod or striker 27 projecting from one end of the piston 22 and extending loosely through a central hole 28 in the damper 24 and through an axial central hole 29 in the tool body 20. The driving rod 27 is slidably received in a cylindrical barrel 30 which in turn is slidably received in a cylindrical holder 31 secured to an annular boss 32 of the tool body 20. The barrel 30 is normally urged forwardly (downwardly in FIG. 1) by means of a compression coil spring 33 acting between the tool body 20 and the barrel 30. The barrel 30 has a pair of axial grooves 34 extending from the rear end (upper end) thereof for normally connecting the axial central hole 29 of the tool body 20 in fluid communication with a pair of radial holes 35 formed in the boss 32 of the tool body 20. The radial holes 35 open to atmospheric air. The radial holes 35 in the tool body 20, the axial grooves 34 in the barrel 30, the axial central hole 29 in the tool body 20, and the central hole 28 in the damper 24 jointly form a vent hole 36 for letting compressed air escape from the lower piston chamber 25 to atmosphere. The vent hole 36 is opened and closed by the barrel 30 when the barrel 30 is reciprocated between an advanced position and a retracted position remote from the advanced position so that the barrel 30 solely constitutes a control member for selectively completing and blocking the vent hole 36. The barrel 30 is normally disposed in the advanced position to open the vent hole 36.

The barrel 30 has at its forward end (lower end in FIG. 1) a fastener retaining portion 37 for retaining therein a fastener 38. The fastener retaining portion 37 includes a permanent magnet 39 embedded therein for holding the fastener 38 stably in the fastener retaining portion 37 before the fastener 28 is driven into a workpiece 40. In the illustrated embodiment, the fastener 38 is a hook-shaped fastener having a straight leg 38*a* and a curved head 38*b* terminating in a bent end 38*c*. When the hook-shaped fastener 38 is retained in the fastener retaining portion 37, the leg 38*a* is held in contact with an inner guide surface 37*a* of the barrel 30 while the bent end portion 38*c* projects outwardly through an axial slot 37*b* in the barrel 30 and is held in contact with an inner guide surface 31*a* of the holder 31. The head 38*b* is normally spaced from the flat forward end 27*a* of the driving rod 27 to such an extent that the barrel 30 as it is retracted by the fastener 38 closes or blocks the vent hole 36 before the head 38*b* engages the forward end 27*a* of the driving rod 27.

Figure 6:
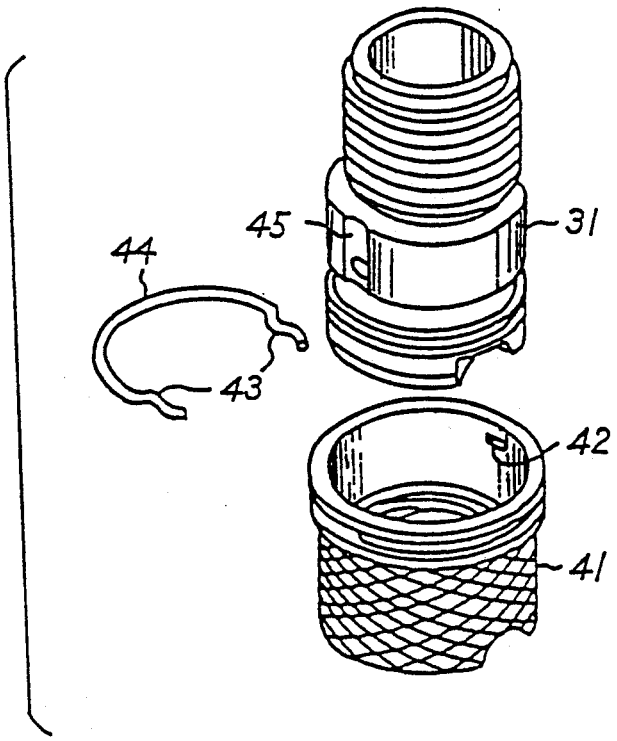
FIG. 6 is an exploded perspective view of a driving depth adjustment device incorporated in the fastener driving tool.

The fastener driving tool of the present invention further includes a driving depth adjustment device for adjustably setting an extent to which the fastener 38 is driven into the workpiece 40. The driving depth adjustment device includes a sleeve 41 threaded over an externally threaded lower portion of the holder 31. As shown in FIG. 6, the sleeve 41 has a pair of diametrically opposed radial openings 42 through which two opposed locking projections 43 on a C-shaped ratchet spring 44 project radially inwardly of the sleeve 41 and snap into arcuate peripheral recesses 45 in the holder 31. With this arrangement, the distance H1 between the forward end 27*a* of the driving rod 27 and a forward end 41*a* of the sleeve 41 can be adjusted by turning the sleeve 41 in either direction. During that time, the locking projections 43 of the ratchet spring 44 are clicked with the arcuate recesses 45 in the holder 31 at angular intervals of 180 degrees, so that the driving depth adjustment operation can be achieved accurately with utmost ease.

When a fastener 38 is to be driven into the workpiece 40 by the pneumatic fastener driving tool of the present invention, the fastener 38 is manually set in the fastener retaining portion 37 of the barrel 30, as shown in FIG. 1. In this instance, the vent hole 36 is completed and is open to atmosphere. While a tip end 38*d* of the fastener 38 is held in register with a desired position on the workpiece 40, the tool body 20 is forced toward the workpiece 40. In response to this forcible movement of the tool body 20, the barrel 30 is retracted by the fastener 38 against the force of the compression coil spring 33. With this retracting movement of the barrel 30, the axial grooves 34 in the barrel 30 are moved into the axial central hole 29 in the tool body 20 and, while at the same time, the radial holes 35 are separated from the axial central hole 29. The vent hole 36 is thus interrupted.

Figure 2:
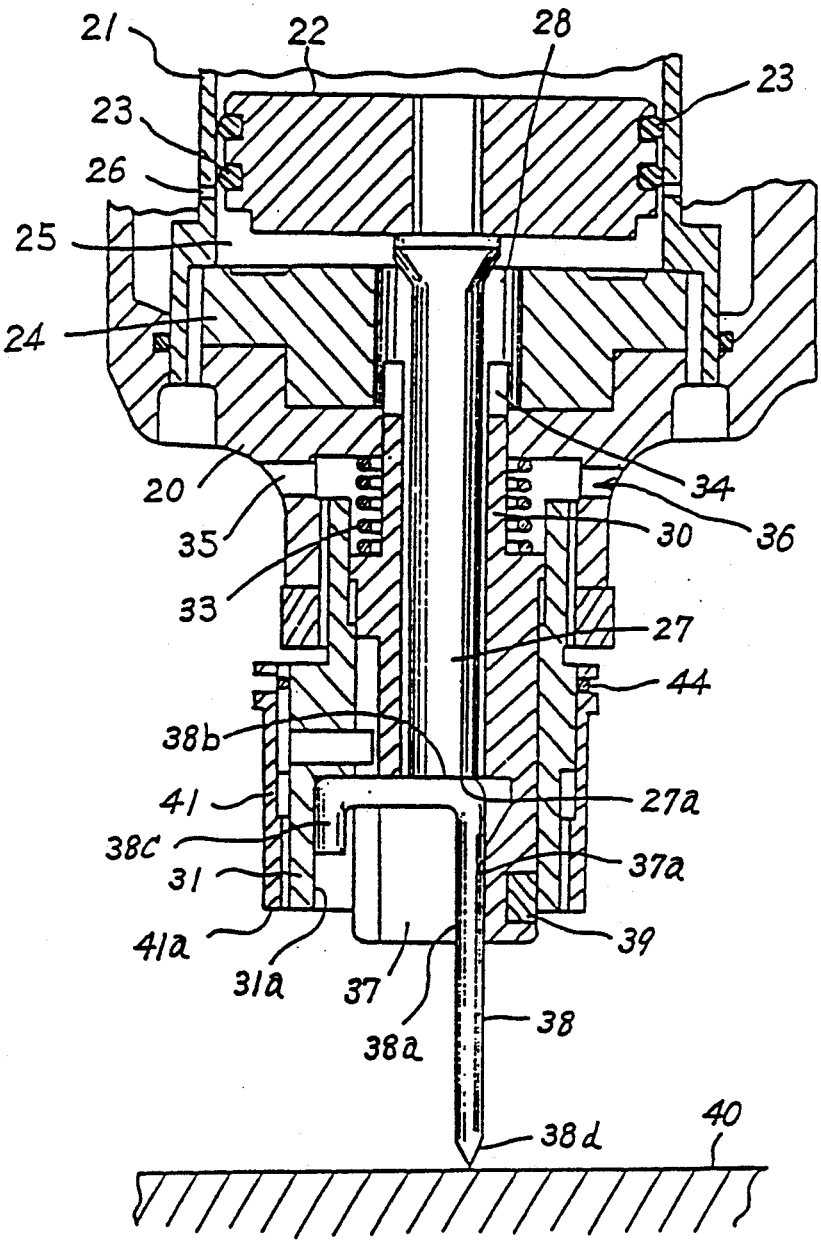
FIG. 2 is a view similar to FIG. 1, but showing the fastener driving tool with parts in a different operating condition.
Figure 4:
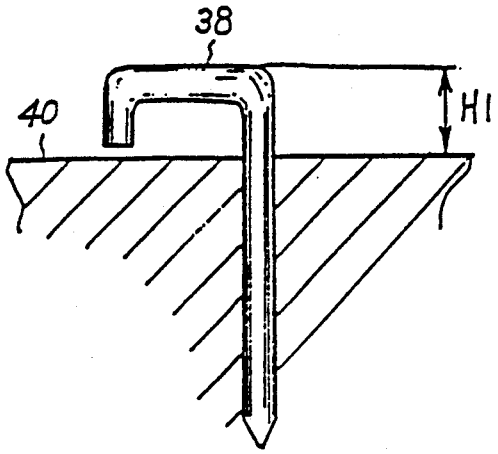
FIG. 4 is a front elevational view of a hook-shaped fastener driven into a workpiece to a first extent using the fastener driving tool shown in FIG. 1.

As the tool body 20 is further thrust toward the workpiece 40, the head 38*b* of the fastener 38 engages the forward end 27*a* of the driving rod 27 and then moves the driving rod 27 and the piston 33 rearward. A continued rearward movement of the piston 33 causes the O-ring 23 to move past the start valve 26, as shown in FIG. 2 whereupon compressed air rushes into the lower piston chamber 25 to push the piston 22 rearward, thereby starting the forward fastener striking movement of the piston 22 and the driving rod 27. Thus, the fastener 38 is driven into the workpiece 40 until the forward end 41*a* of the sleeve 41 engages the workpiece 40. Due to the distance H1 (FIG. 1) provided between the forward end 27*a* of the driving rod 27 and the forward end 41*a* of the sleeve 41, the fastener 38 driven into the workpiece 40 projects from the workpiece 40 by the distance H1, as shown in FIG. 4. Since the leg 38*a* and the bent end 38*c* of the fastener 38 are stably guided respectively by the guide surface 37*a* of the barrel 30 and the guide surface 31*a* of the holder 31 during driving operation, the fastener 38 is driven neatly into the workpiece 40 without deformation or tilting.

After the fastener driving operation, the thrust or pressure on the tool body 20 is released whereupon the barrel 30 is returned to its advanced position by the force of the spring 33. With this advancing or forward movement of the barrel 30, the central hole 28 in the damper 24, the axial central hole 29 in the tool body 20, the axial grooves 34 in the barrel 30, and the radial holes 35 in the tool body 20 communicate with each other to thereby complete the vent hole 36 opening to atmospheric air, as shown in FIG. 1. With the vent hole 36 thus completed, when the start valve 26 is accidentally opened due to bouncing of the piston 22 or undue pneumatic force acting on the piston 22 after one cycle of the fastener driving operation is completed, compressed air flowing through the start valve 26 into the lower piston chamber 25 is directed to atmosphere. Consequently, an undesired pressure rise in the lower piston chamber 25 does not take place and hence an accidental start of the fastener driving operation can be prevented. Furthermore, the vent hole 36 is blocked while the fastener is being driven to the workpiece 40, so that the fastener driving operation can be achieved efficiently and safely without power loss.

Another advantage attained by the fastener driving tool is that the fastener 38 loaded in the barrel 30 is separated from the driving rod 27 until the barrel 30 is thrust backward against the force of the spring 33. With this arrangement, loading of the fastener can be achieved with safety.

Figure 3:
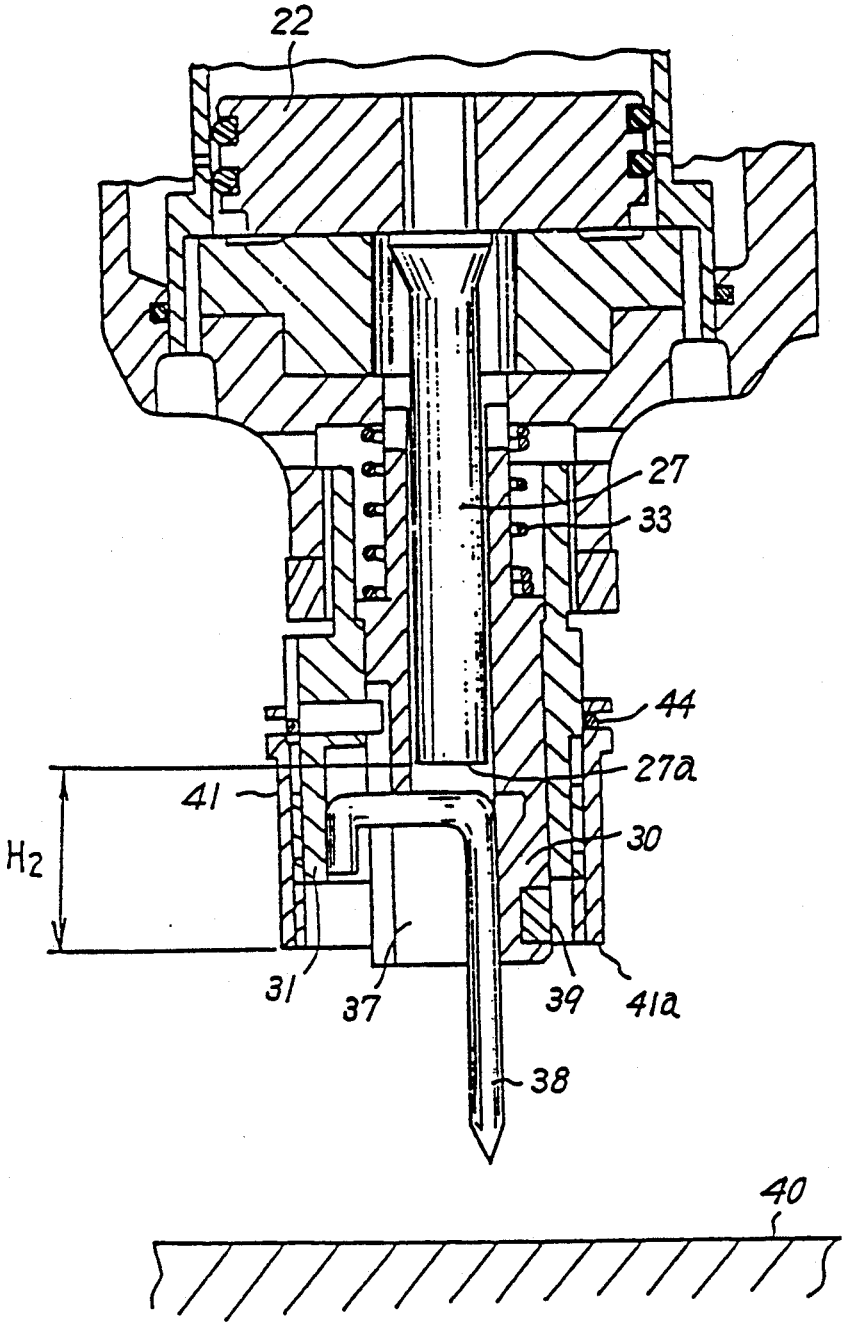
FIG. 3 is a fragmentary longitudinal cross-sectional view illustrative of the operation of a driving depth adjustment device incorporated in the pneumatic fastener driving tool.
Figure 5:
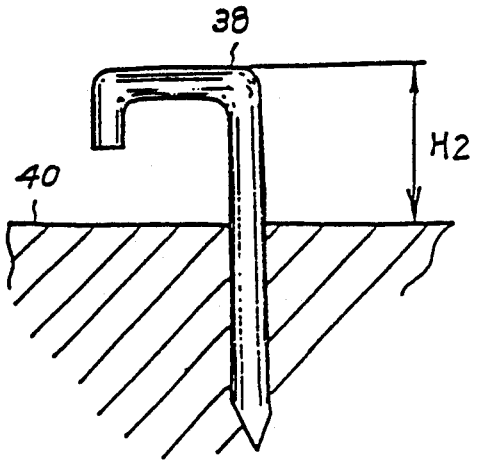
FIG. 5 is a front elevational view of a hook-shaped fastener driven into a workpiece to a second extent using the fastener driving tool shown in FIG. 3.

When the fastener 1 is to be driven to the workpiece 40 in the manner shown in FIG. 5, the sleeve 41 is turned until the distance H2 (FIG. 3) between the forward end 27*a* of the driving rod 27 and the forward end 41*a* of the sleeve 41 is in equal to the height H2 (FIG. 5) of a portion of the fastener 38 projecting from the workpiece 40.

Figure 7:
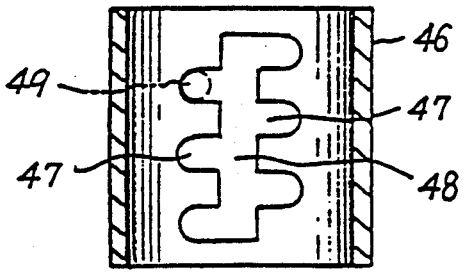
FIG. 7 is a cross-sectional view of a modified form of the driving depth adjustment device.

FIG. 7 shows a modified fastener driving depth adjustment sleeve 46 having a plurality of parallel spaced circumferential grooves 47 connected at one end to an axial groove 48. A selected one of the circumferential grooves 47 receives a pin 49 projecting laterally outwardly from a holder (not shown but similar to the holder 31 shown in FIG. 1) when the sleeve 46 is fitted around the holder. With the sleeve 46 thus provided, the fastener driving depth can be adjusted stepwise.

Figure 8:
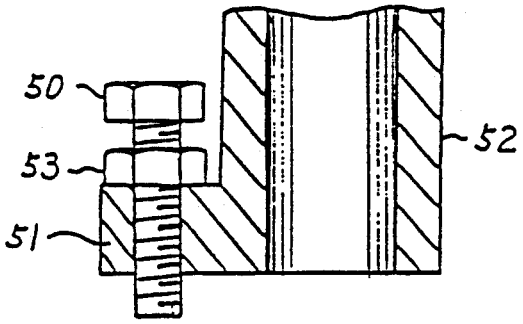
FIG. 8 is a view similar to FIG. 7, but showing another modified driving depth adjustment device according to the invention.

A modified fastener driving depth adjustment device shown in FIG. 8 comprises an adjustment screw 50 threaded to a flange 51 of a holder 52, and a lock nut 53 threaded over the adjustment screw 50 to lock the latter in position against displacement. The adjustment screw 50 extends through the flange 51 and is engageable with a workpiece, not shown.

Figure 9:
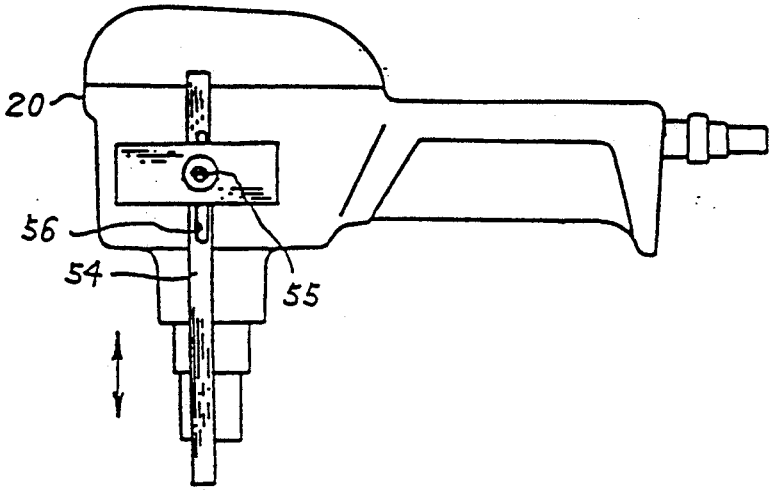
FIG. 9 is a front elevational view, on reduced scale, of a fastener driving tool having a driving depth adjustment device.

FIG. 9 shows a fastener driving depth adjustment device composed of an elongate adjustment plate 54 attached to the tool body 20 by a set screw 55 extending loosely through a longitudinal oblong hole 56 in the adjustment plate 54. The adjustment plate 54 thus attached is adjustable in position in a direction (indicated by the arrowheads) parallel to the direction of movement of a driving rod, not shown.

Figure 10:
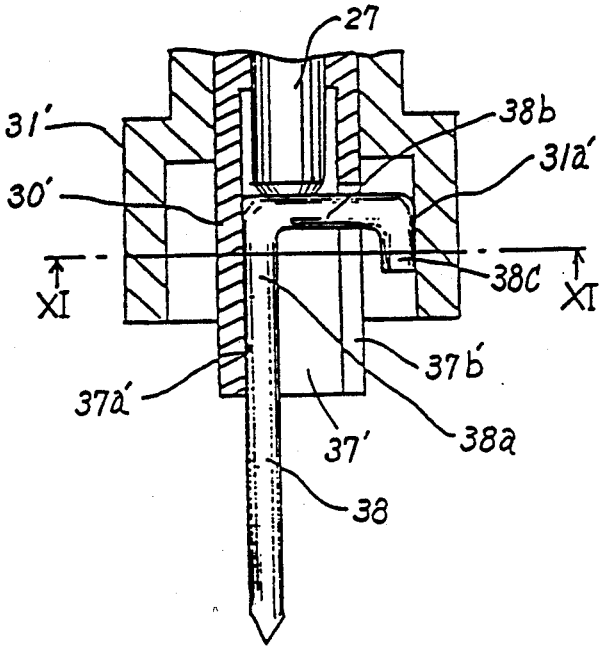
FIG. 10 is a fragmentary longitudinal cross-sectional view of a pneumatic fastener driving tool having a fastener guide member according to the present invention.
Figure 11:
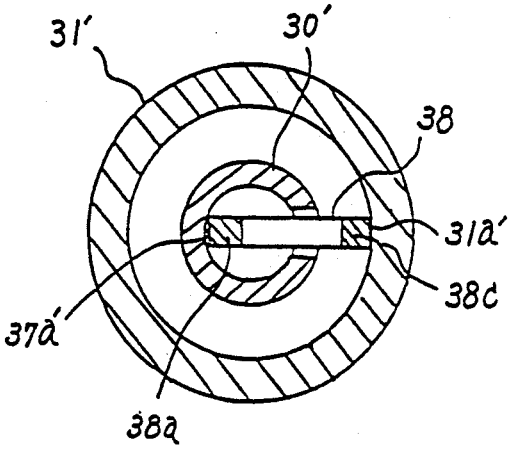
FIG. 11 is a cross-sectional view taken along line XI—XI of FIG. 10.

FIGS. 10 and 11 illustrate a modified form of the fastener driving end portion of the fastener driving tool. The modified fastener driving end portion is substantially the same as that of the foregoing embodiment shown in FIG. 1 excepting that the holder 31' has an annular shape having a circular guide surface 31*a'* engageable with the bent end portion 38*c* of a hook-shaped fastener 38. The fastener retaining portion 37' of the barrel 30' also has a circular guide surface 37*a'* engageable with a leg 38*a* of the fastener 38. With the guide surfaces 31*a'*, 37*a'* thus provided, the fastener 38 is neatly driven into a workpiece without deformation or tilting.

Figure 12:
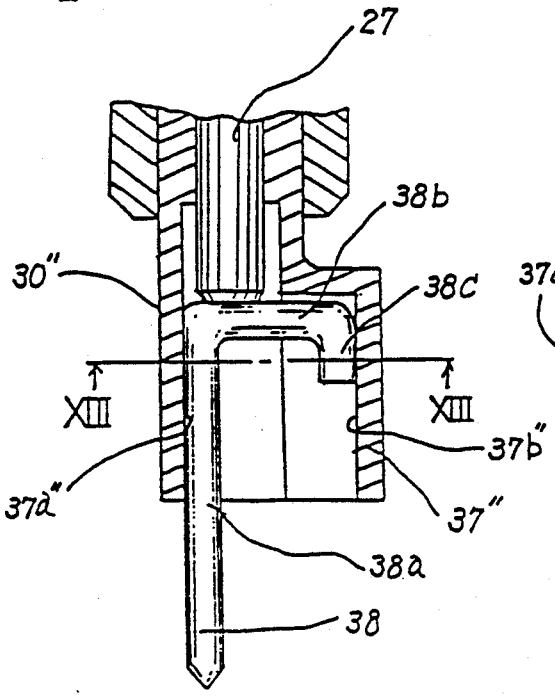
FIG. 12 is a view similar to FIG. 10, but showing a modified form of the fastener guide member.
Figure 13:
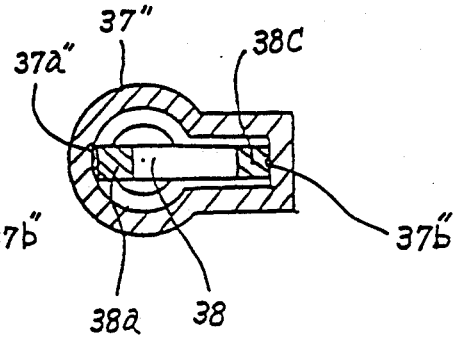
FIG. 13 is a cross-sectional view taken along line XIII—XIII of FIG. 12.
Figure 14:
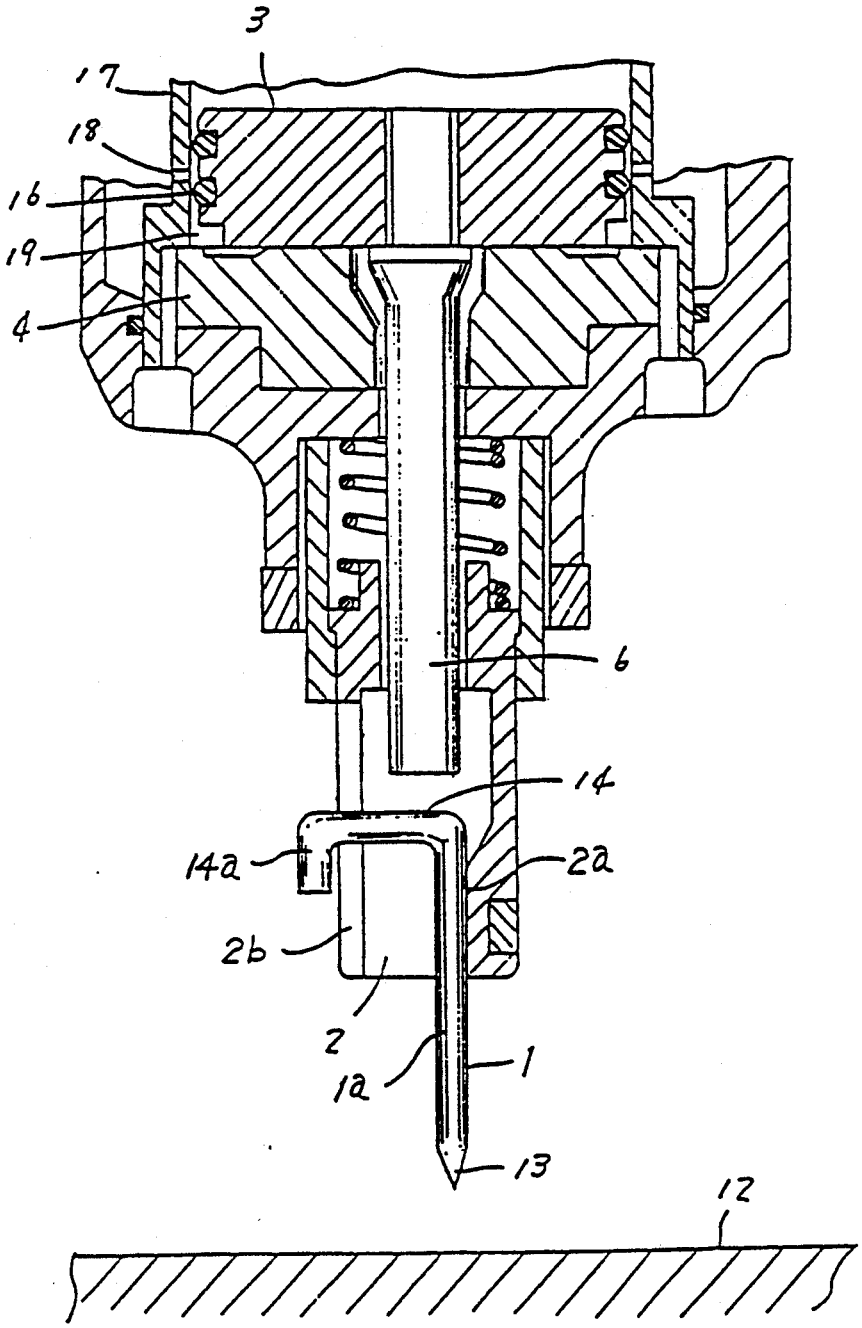
FIG. 14 PRIOR ART
FIG. 14 is a fragmentary longitudinal cross-sectional view of a conventional pneumatic fastener driving tool.
Figure 15:
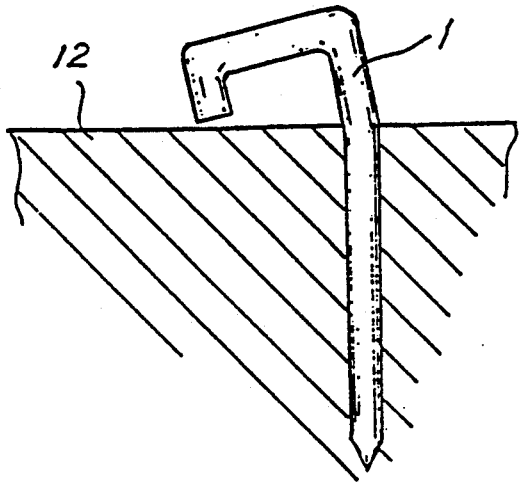
FIGS. 15 and 16 are front elevational views of hook-shaped fasteners driven into workpieces using the conventional fastener driving tool shown in FIG. 14.
Figure 16:
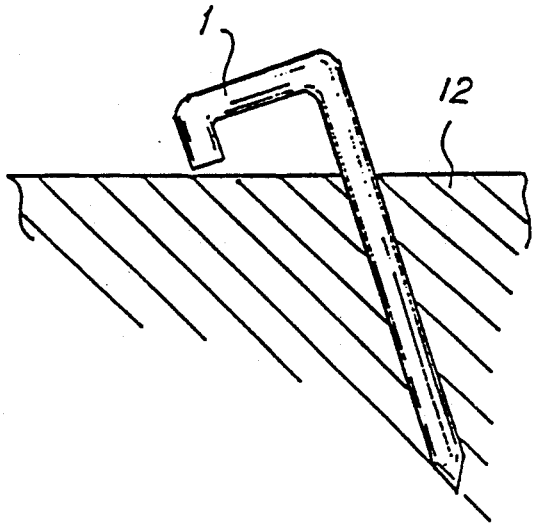

A modified fastener driving end portion 30'' shown in FIGS. 12 and 13 includes a slender fastener retaining portion 37'' in the form of a keyhole having an arcuate guide surface 37*a''* engageable with the straight leg 38*a* of a hook-shaped fastener 38, and a flat guide surface 37*b''* engageable with the bent end portion 38*c* of the fastener 38. Advantageously, the fastener driving end portion of this embodiment is smaller in size than that of the foregoing embodiment shown in FIGS. 10 and 11.

Obviously various minor changes and modifications of the present invention are possible in the light of the above teaching. It is therefore to be understood that within the scope of the appended climes the invention may be practiced otherwise than as specifically described.

What is claimed is:

1. A pneumatic fastener driving tool, comprising:

a reciprocating piston driven by compressed air and having a driving rod for driving a fastener into a workpiece;

a cylinder slidably receiving therein said piston and having at least one radial hole, said radial hoe constituting a start valve operative to start a fastener driving operation by said driving rod depending on the position of said piston relative to said start valve, said start valve being adapted to be open in response to rearward movement of said driving rod;

a fastener driving end portion for holding therein a fastener in front of said driving rod;

means defining a vent hold for connecting said start valve to atmospheric air to let compressed air escape to atmosphere;

a control member disposed in said fastener driving end portion and reciprocally movable in a direction parallel to the direction of movement of said driving rod between a first position to open said vent hold and a second position to close said vent hole, said control member being normally disposed in said first position;

means for adjusting the distance between a forward end of said driving rod and a workpiece to which the fastener is to be driven;

a cylindrical stationary holder in which said control member is slidably received, said distance adjusting means comprising a cylindrical sleeve threaded over said holder and movable relative to said holder in a direction parallel to the longitudinal axis of said driving rod, said sleeve having a forward end engageable with the workpiece.

2. A pneumatic fastener driving tool as claimed in claim 1, wherein said sleeve has at least one radial opening, said stationary holder has a recess in its peripheral surface, said distance adjustment means further including a ratchet spring fitted around said sleeve and having a projection extending into said radial opening and lockingly engageable with said recess.

3. A pneumatic fastener driving tool, comprising:

a reciprocating piston driven by compressed air and having a driving rod for driving a fastener into a workpiece;

a cylinder slidably receiving therein said piston and having at least one radial hole, said radial hole constituting a start valve operative to start a fastener driving operation by said driving rod depending on the position of said piston relative to said start valve, said start valve being adapted to be open in response to rearward movement of said driving rod;

a fastener driving end portion for holding therein a fastener in front of said driving rod;

a control member disposed in said fastener driving end portion and reciprocally movable in a direction parallel to the direction of movement of said driving rod between a first position to open said vent hole and a second position to close said vent hole, said control member being normally disposed in said first position;

a tool body holding therein said cylinder, said tool body having an axial hole extending parallel to a longitudinal axis of said cylinder and at least one radial hole extending perpendicularly to said axial hole;

a ring-shaped damper disposed in said tool body at an end of said cylinder so as to define jointly with said piston a lower piston chamber into which compressed air is supplied through said start valve, said damper having a central hole connected at one end to said axial hole in said tool body; and a cylindrical barrel constituting said control member and having an axial groove interconnecting said axial hole and said radial hole of aid tool body when said barrel is disposed in said first position, wherein said axial hole and said radial hole of said cylinder and said central hole and said axial groove of said damper cooperate to define a vent means for correcting said start valve to atmospheric air to enable an escape of said compressed air to atmosphere.

4. A pneumatic fastener driving tool as claimed in claim 3, wherein said barrel has a fastener retaining portion for holding therein the fastener in spaced relation to said driving rod to such an extend that said barrel reaches its second position to close said vent hole before the fastener engages a forward end of said driving rod.

5. A pneumatic fastener driving tool as claimed in claim 3, further including means for adjusting the distance between a forward end of said driving rod and a workpiece to which the fastener is to be driven.

6. A pneumatic fastener driving tool as claimed in claim 5, further including a cylindrical stationary holder in which said control member is slidably received, said holder having a flange, said distance adjusting means comprising an adjustment screw threaded through said flange and engageable with the workpiece, and a lock nut threaded over said adjustment screw for locking the latter in position against displacement.

7. A pneumatic fastener driving tool as claimed in claim 5, further including a tool body in which said driving rod is mounted, said distance adjustment means comprising an elongate plate extending parallel to the longitudinal axis of said driving rod and having a longitudinal oblong hole, and a screw extending loosely through said oblong hole and threaded to said tool body to attached the elongate plate to said tool body.

8. A pneumatic fastener driving tool as claimed in claim 5, further including a cylindrical stationary holder in which said control member is slidably received, said distance adjusting means comprising a cylindrical sleeve slidably mounted on said holder and movable relative to said holder in a direction parallel to the longitudinal axis of said driving rod, said sleeve having a plurality of parallel spaced circumferential grooves at one end thereof, and a pin projecting from said holder and receivable in a selected one of said circumferential grooves.

9. A pneumatic fastener driving tool as claimed in claim 3, for sue in combination with a hood-shaped fastener having a straight leg and a curved head terminating in a bent end portion, wherein said fastener driving end portion has a first guide surface engageable with the leg of the fastener and a second guide surface engageable with the bent end portion of the fastener.

10. A pneumatic fastener driving tool as claimed in claim 9, wherein said fastener driving end portion includes a stationary holder and a barrel slidably received in said holder, said barrel having an inside surface constituting said first guide surface, said holder having an inside surface constituting said second guide surface.

11. A pneumatic fastener driving tool as claimed in claim 10, wherein said first and second guide surfaces are arcuate.

12. A pneumatic fastener driving tool as claimed in claim 9, wherein said fastener driving end portion includes a stationary holder and a barrel slidably received in said holder, said barrel having diametrically opposed surfaces constituting said first and second guide surfaces.

13. A pneumatic fastener driving tool as claimed in claim 12, wherein said barrel includes a keyhole-like fastener retaining portion, said first and second guide surfaces being provided on said fastener retaining portion, said first guide surface being arcuate and said second guide surface being flat.

* * * * *